US008550142B2

(12) United States Patent
Gaskill et al.

(10) Patent No.: US 8,550,142 B2
(45) Date of Patent: Oct. 8, 2013

(54) VERTICAL HUNG WINDOW SHADE ASSEMBLY WITH ROLL UP AND SIDE SHIFTING DUAL PANEL OR PANELS

(76) Inventors: Robert D. Gaskill, Bolingbrook, IL (US); Ernest DiSilvestro, Itasca, IL (US)

( * ) Notice: Subject to any disclaimer, the term of this patent is extended or adjusted under 35 U.S.C. 154(b) by 82 days.

(21) Appl. No.: 13/279,093

(22) Filed: Oct. 21, 2011

(65) Prior Publication Data

US 2012/0097344 A1 Apr. 26, 2012

Related U.S. Application Data

(60) Provisional application No. 61/405,489, filed on Oct. 21, 2010.

(51) Int. Cl.
*E06B 9/08* (2006.01)

(52) U.S. Cl.
USPC ..... 160/121.1; 160/120; 160/85; 160/179

(58) Field of Classification Search
USPC ..... 160/120, 126, 85, 86, 179, 242, 237, 160/263, 321, 323.1, 343, 130, 133, 186, 160/193, 220
See application file for complete search history.

(56) References Cited

U.S. PATENT DOCUMENTS

| | | | | |
|---|---|---|---|---|
| 58,668 | A | 10/1866 | Morrison | |
| 2,280,358 | A | 4/1942 | Tietig | |
| 2,702,081 | A * | 2/1955 | North et al. | 160/120 |
| 5,647,421 | A * | 7/1997 | Hoffmann et al. | 160/120 |
| 6,189,592 | B1 | 2/2001 | Domel | |
| 6,651,720 | B1 | 11/2003 | DiSilvestro | |
| 8,025,088 | B2 * | 9/2011 | Kim | 160/120 |
| 2008/0308238 | A1 * | 12/2008 | Ito | 160/67 |
| 2009/0173454 | A1 * | 7/2009 | Cheng | 160/120 |
| 2012/0097344 | A1 * | 4/2012 | Gaskill et al. | 160/168.1 V |
| 2013/0098564 | A1 * | 4/2013 | Jang | 160/120 |

* cited by examiner

*Primary Examiner* — Blair M. Johnson
(74) *Attorney, Agent, or Firm* — Howard B. Rockman

(57) ABSTRACT

A plural panel vertically hung horizontally adjustable light transmitting window shade apparatus for varying the amount of light from zero to maximum that can pass through alternate transparent and opaque portions of the plural panels. The plural panels hang vertically downward from separate mounting elements of a control mechanism. The control mechanism, when actuated, moves either one or two of the plural panels horizontally relative to the other panel, thus changing the position of the transparent portions and opaque portions of each panel. The control mechanism also vertically deploys or retracts the dual panels using the same control mechanism used to move the panels horizontally. A bottom rail maintains the lower ends of the panels in a closely adjacent position, and also allows relative vertical movement of each panel relative to the other when the panels are either deployed or retracted.

11 Claims, 13 Drawing Sheets

4B
4B
4C
4C 5B
5C
5D 10B
10C 11B
11B
11C
11C

VERTICAL HUNG WINDOW SHADE ASSEMBLY WITH ROLL UP AND SIDE SHIFTING DUAL PANEL OR PANELS

The present invention claims priority of provisional application Ser. No. 61/405,489, filed Oct. 21, 2010, the contents of which are hereby incorporated by reference.

FIELD OF THE INVENTION

The present invention relates generally to window treatment apparatus, and more particularly to a dual panel roll-up window shade apparatus with an improved mechanism for vertically deploying a plurality of window shade panels from or onto a slotted tube or spool, and for horizontally shifting one or both panels relative to each other to vary the amount of light passing from the window and through the shade panels.

BACKGROUND OF THE INVENTION

Window treatments are well known. In addition to aesthetic features, window treatments also provide privacy, protection from excessive sunlight, and thermal insulation. Certain previously developed window treatments include dual shade panels made of a fabric or other flexible material, whereby the dual shade panels can alternatively be wound onto and deployed from a single spool, and once deployed, the dual panels hang adjacent one another and may be shifted vertically relative to one another to adjust the amount of sunlight passing through the shade panels. Examples of such vertically shiftable window treatments are disclosed in U.S. Pat. Nos. 58,668; 2,280,358; 6,189,592 and applicants' U.S. Pat. No. 6,651,720.

There is a need in the window treatment art for a combination dual panel, roll up shade apparatus where the panels are vertically deployed and rolled up, and one or both of the panels are also capable of shifting horizontally in relation to each other to very the amount of light passing through the shade panels.

There is also a need for the combination window shade apparatus having a single control mechanism that allows a user to vertically deploy and roll up the shade panels, and to shift the shade panels horizontally.

SUMMARY OF THE INVENTION

A first embodiment of the present invention is a plural shade panel vertically-hung adjustable light-transmitting window shade apparatus. Alternate panels are of the same width, and are alternately transparent and opaque. The apparatus varies the amount of light passing through the plural panels by shifting the panels horizontally, variably aligning the transparent and opaque panels. The apparatus has a rotatable slotted tube having an outer surface, and the tube is rotatably mounted in a canopy. The canopy has a chamber formed therein and an opening facing downward from the canopy with the shade panels extending downwardly from the opening.

The apparatus has an operating shaft mounted for rotation within the chamber. At least one shifting nut threadingly engages the operating shaft such that rotation of the operating shaft imparts a lateral or horizontal movement to the shifting nut. At least one mounting surface engages the shifting nut and lateral movement of the shifting nut imparts lateral movement to the mounting surface.

At least one shade panel is attached to the at least one mounting surface. The shade panels extend downward from the chamber and are movable in a lateral direction upon rotation of the operating shaft. The apparatus also vertically deploys and retracts both shade panels simultaneously.

DETAILED DESCRIPTION OF THE ILLUSTRATED EMBODIMENTS

Figure 1:
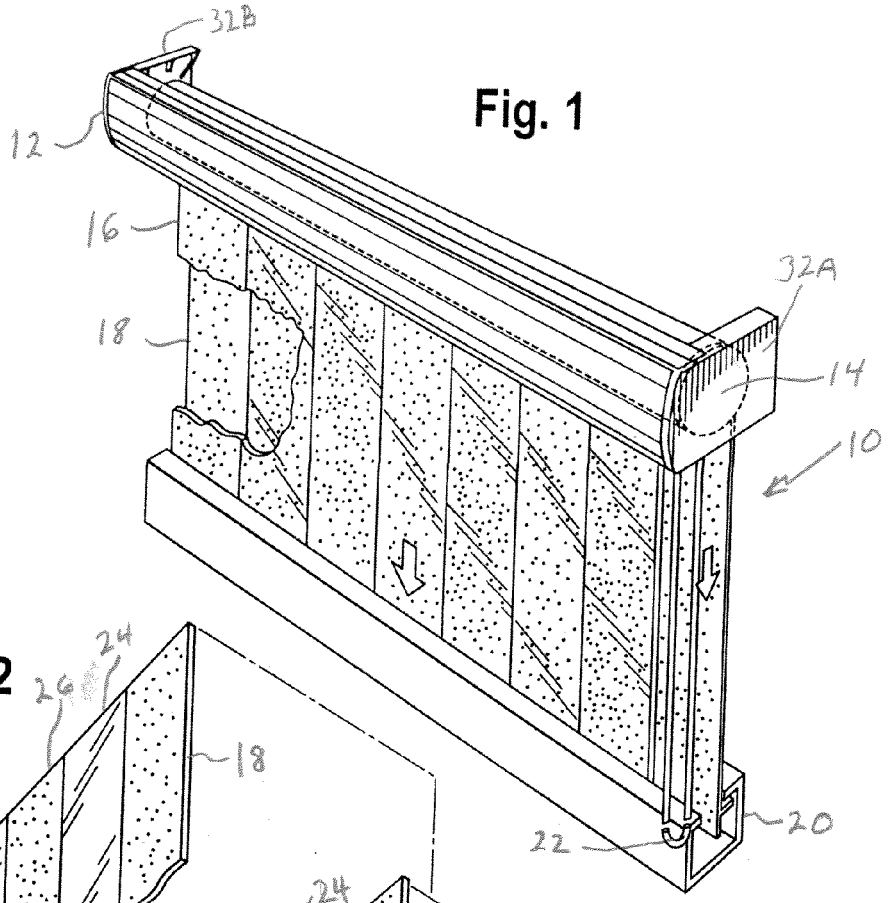
FIG. 1 is a front perspective view of an embodiment of the vertical hung window shade assembly of the present invention.

Referring to FIG. 1 an embodiment of the vertical hung window shade assembly 10 of the present invention, is shown, having an upper canopy 12 housing, an operating or control mechanism 14 for vertically deploying and retracting the two vertically hung forward 16 and rear 18 panels and for horizontally shifting the relative position of the two fabric panels 16, 18. FIG. 1 also shows the bottom rail 20 at the lower ends of the two shade panels 16, 18, and a cord or chain 22 providing manual control of the deployment, retraction and relative shifting of the two shade panels.

Figure 2:
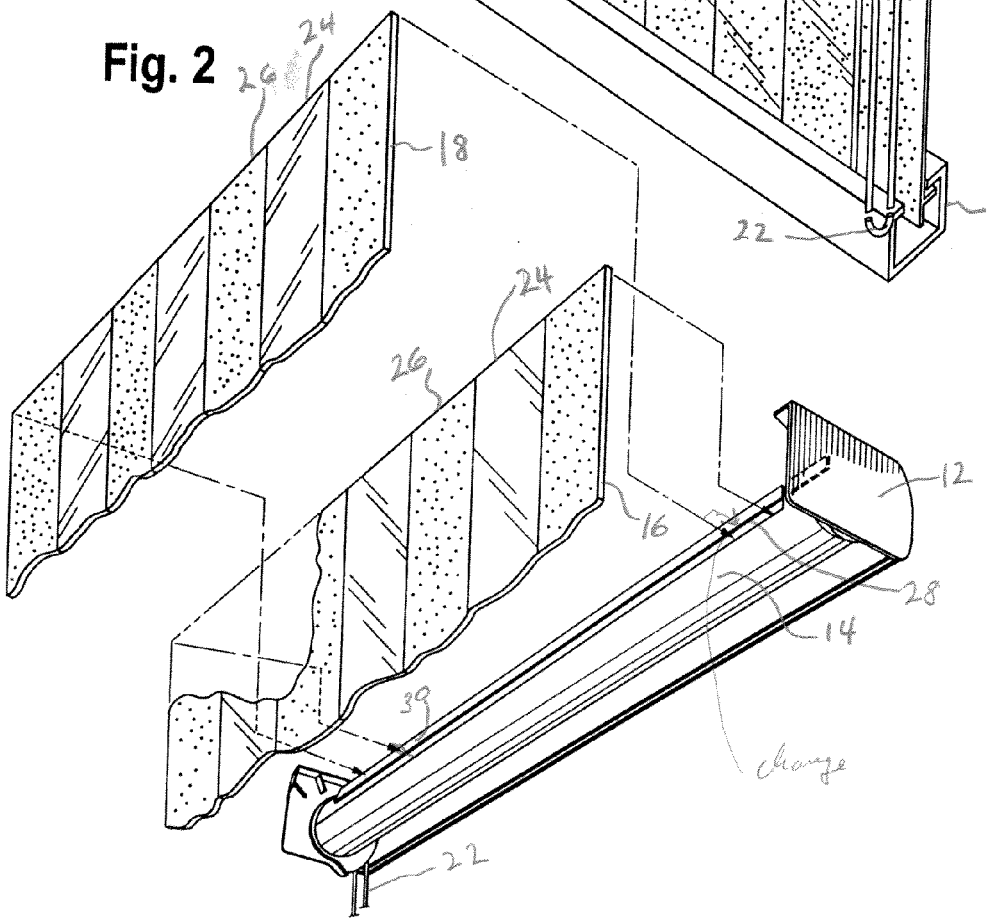
FIG. 2 is a partial rear perspective exploded view of the dual horizontally movable shifting mechanisms of the embodiment of FIG. 1.

As seen in FIG. 2, each shade panel 16, 18 comprises alternate lengths of transparent material 24 and opaque material 26, and the upper portion of each panel 16, 18 is separately attached to a respective one of dual shifting mechanisms 28, 30, as will be explained. The outer edges of canopy 12 comprise opposed brackets 32A, B that are used to attach the shade assembly 10 to a wall or window frame. The shade panels 16, 18 can be made of fabric, plastic or any other suitable material as is known in the art.

Figures 3, 3A:
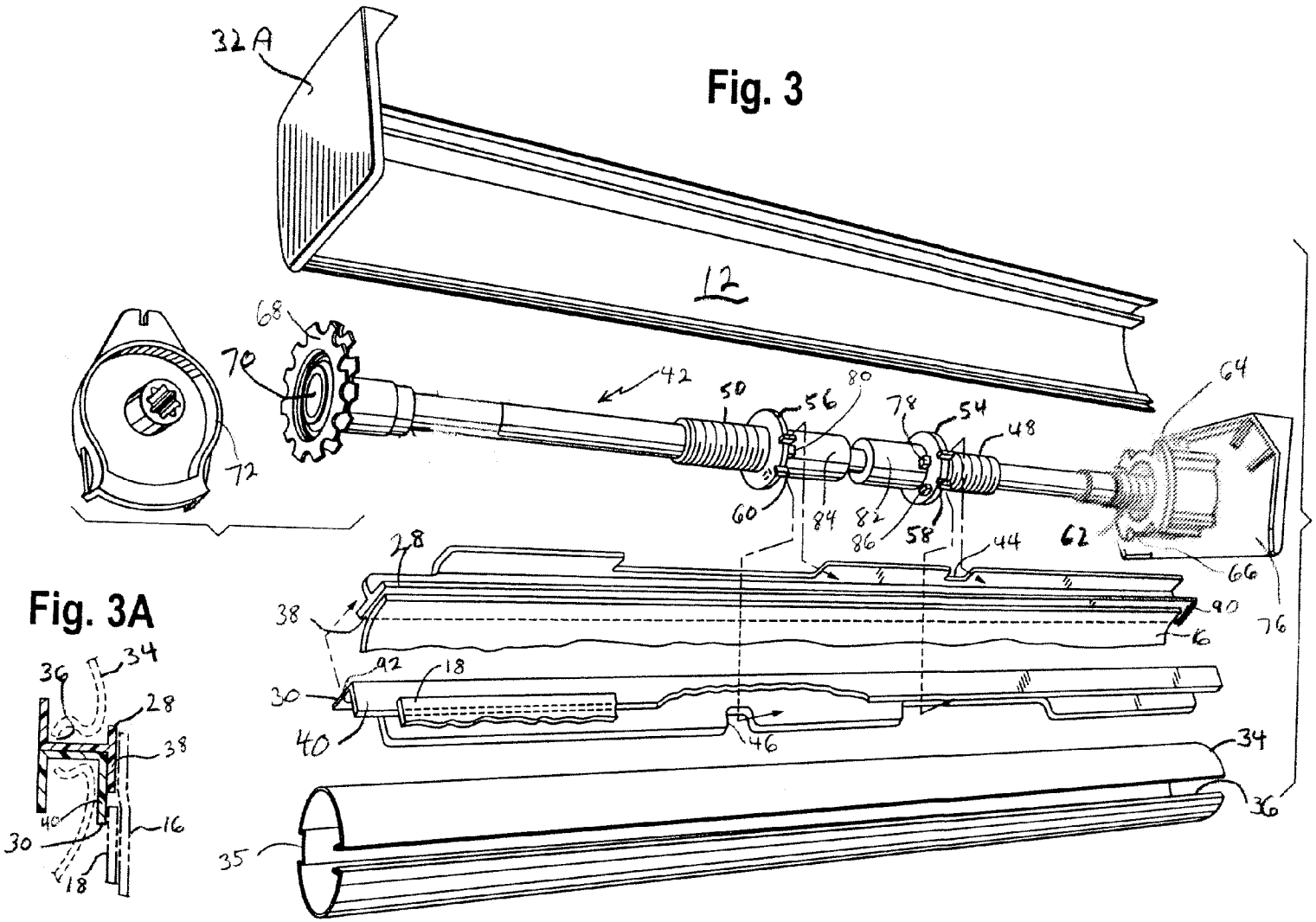
FIG. 3 is an exploded perspective schematic view of the shade operating mechanism disposed beneath the canopy of the embodiment of FIG. 1.
FIG. 3A is a detail cross-sectional view of the slotted tube of FIG. 3, taken along line 3A-3A of FIG. 3.

FIG. 3 illustrates the shade operating mechanism 14 disposed beneath the canopy 12 of the embodiment of the invention illustrated in FIG. 1. The operating mechanism 14 includes slotted tube 34 which the dual shade panels 16, 18 engage during deployment and retraction of the panels. As will be explained, the dual shade panels 16, 18 extend outward from tube 34 through slot 36. The dual horizontally moveable shifter mechanisms substantially located in the slotted tubes 34 have attachment flanges 38, 40 respectively extending through the slot 36 in the tube 34 for attaching one end of each shade panel 16, 18 to the respective shifter mechanisms 28, 30. A control shaft mechanism 42 is located within the slotted tube 34 such that the control shaft mechanism 42 controls the vertical deployment and retraction of the panels 16, 18 as well as the horizontal shifting of the shade panels, as will be explained. Slotted tube 34 also includes an axially and inwardly extending indented portion 35 for purposes to be explained.

Figures 4, 4A, 4B, 4C:
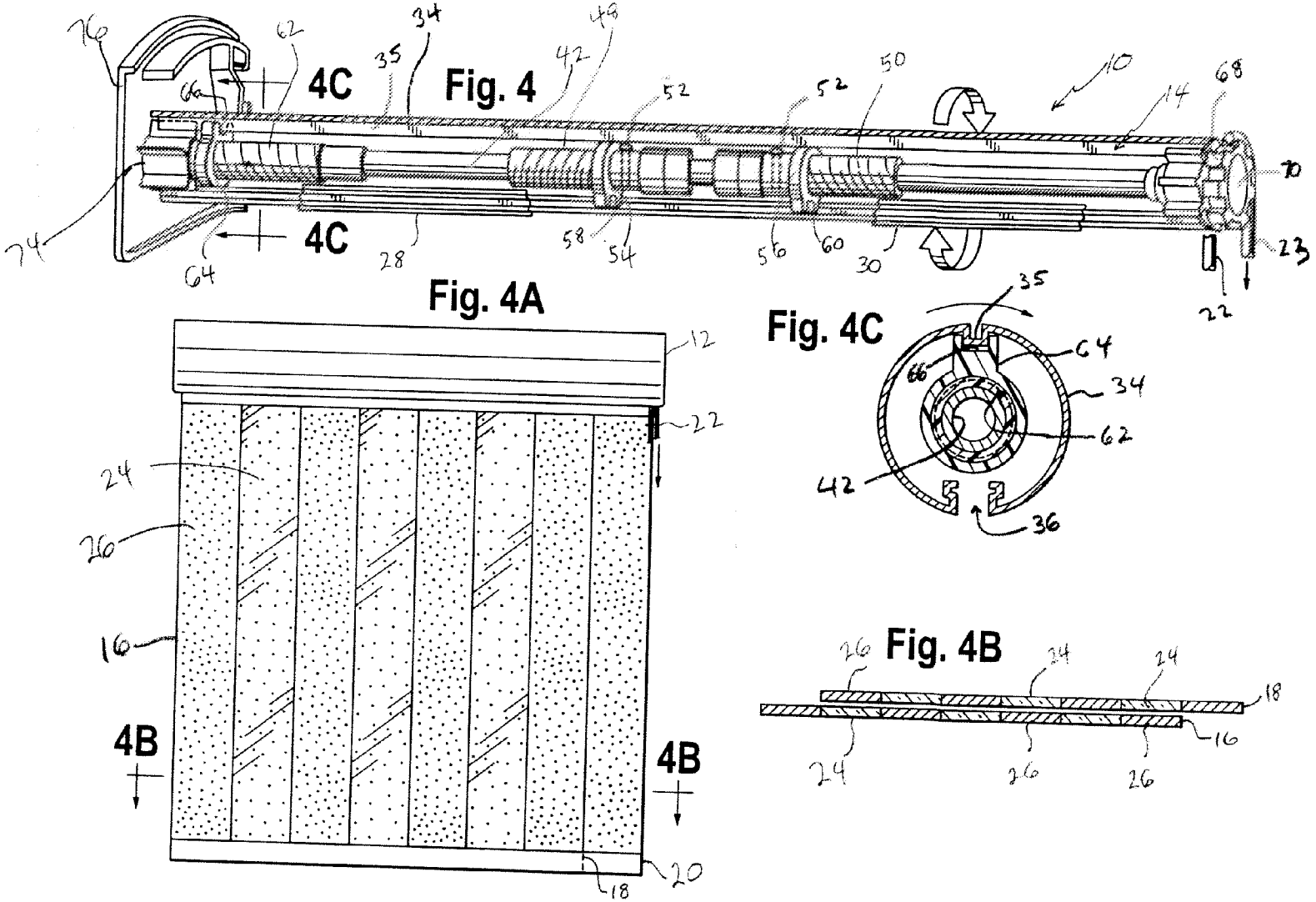
FIG. 4 is an assembly drawing of the shade operating mechanism of FIG. 3, with the control mechanism in its respective positions when the shade panels are fully vertically deployed, and transparent portion of one panel is located adjacent an opaque portion of the other panel, providing maximum privacy.
FIG. 4A is a front elevation view of the window shade assembly of FIGS. 1 and 4, with the shade panels fully vertically deployed.
FIG. 4B is a cross-section view of the shade panels of FIG. 4A, taken along line 4B-4B of FIG. 4A.
FIG. 4C is a cross-section view of the slotted tube, and elements of the shade deployment and retraction operating mechanism, taken along line 4C-4C of FIG. 4.

As seen in FIG. 2, shifting mechanism 28 includes a groove 44, and shifting mechanism 30 includes a groove 46. Control shaft 42 includes a pair of oppositely directed threaded surfaces 48, 50 that are each secured to shaft 42 by pins 52 (FIG. 4). The head of pin 52 extends outward beyond the circumference of shaft 42. Shifter nuts 54, 56 threadingly engage, and are horizontally movable along threaded surfaces 48, 50. each shifter nut 54, 56 includes a pair of spaced radial flanges 58, 60 that as seen in FIG. 3, are adapted to engage slots 44, 46 respectively, such that when each shifter nut 54, 56 moves horizontally, as will be explained, shifting mechanisms 28 and 30 will also move horizontally. Since shade panels 16, 18 are attached to shifting mechanisms 28, 30, respectively, the shade panels 16, 18 will also move horizontally relative to the other.

Shaft 42 includes an additional threaded portion 62 towards one end of shaft 42. A stop limit nut 64 threadingly engages threaded portion 62 of the shaft, and upon the rotation of shaft 42 relative to stop limit nut 64, stop nut 64 moves horizontally along shaft 42. Stop limit nut 64 has a saddle portion 66 adapted to engage indented portion 35 of slotted tube 34, as seen in FIG. 4C, allowing stop limit nut 64 to move laterally along shaft 42, but not rotate relative to slotted tube 34.

Mounted at one end 70 of shaft 42 is a panel deployment and retraction wheel 68 adapted to engage cord or chain 22 (FIG. 1) and provide manual rotation to shaft 42 and to tube 34, as will be explained. An end cap 72 attaches to shaft 70, and provides a cover for cord or chain 22 as it engages wheel 68. The opposite end 74 (FIG. 4) of shaft 42 also supports an end cap 76

As seen in FIG. 3, stops 78, 80 are fixed to enlarged portions 82, 84 of shaft 42. Stops 86 are also located on the facing sides of each shifter nut 54, 56 (only one shown in FIG. 3). When stops 86 engage stops 78 or 80, the shifter nuts 54, 56 cannot rotate any further with respect to shaft 42, as will be explained.

FIG. 3A is a detail cross-sectional view of the slotted tube 34 of FIG. 3, showing the two independently horizontally moveable shifting mechanisms 27, 30 extending from the inside to the outside of the slotted tube 34 through the slot 36 in the tube, and showing the forward and rear shade panels 16, 18 attached to a respective one of the shifter mechanisms 28, 30.

Initially the forward and rear shade panels 16, 18 may be rolled up on the outer surface of slotted tube 34, and stop limit nut 64 is in its stop or idle position towards the center (not shown) of control shaft 42. The shifter nuts 54, 56 are each at their centermost position, as seen in FIG. 4.

Upon the user applying a downward force on side 23 of the operating cord or chain 22, the slotted tube 34 rotates and both the forward and rear shade panels 16, 18 are deployed vertically. The stop limit nut 64 that was initially at its idle or centermost position on the additional threaded portion 62 at the end of the control shaft 42 moves laterally outwardly along the additional threaded portion 62 of the control shaft 42. A stop flange on the stop limit nut ultimately engages a stop on the control shaft, which at this point is stationary and is not rotating. Upon engagement of the stop flange and the stop, shade panels 16, 18 are deployed to their predetermined proper length. As shown in FIGS. 1 and 4, the forward and rear panels are in their full privacy position.

Figures 5, 5A, 5B, 5C, 5D:
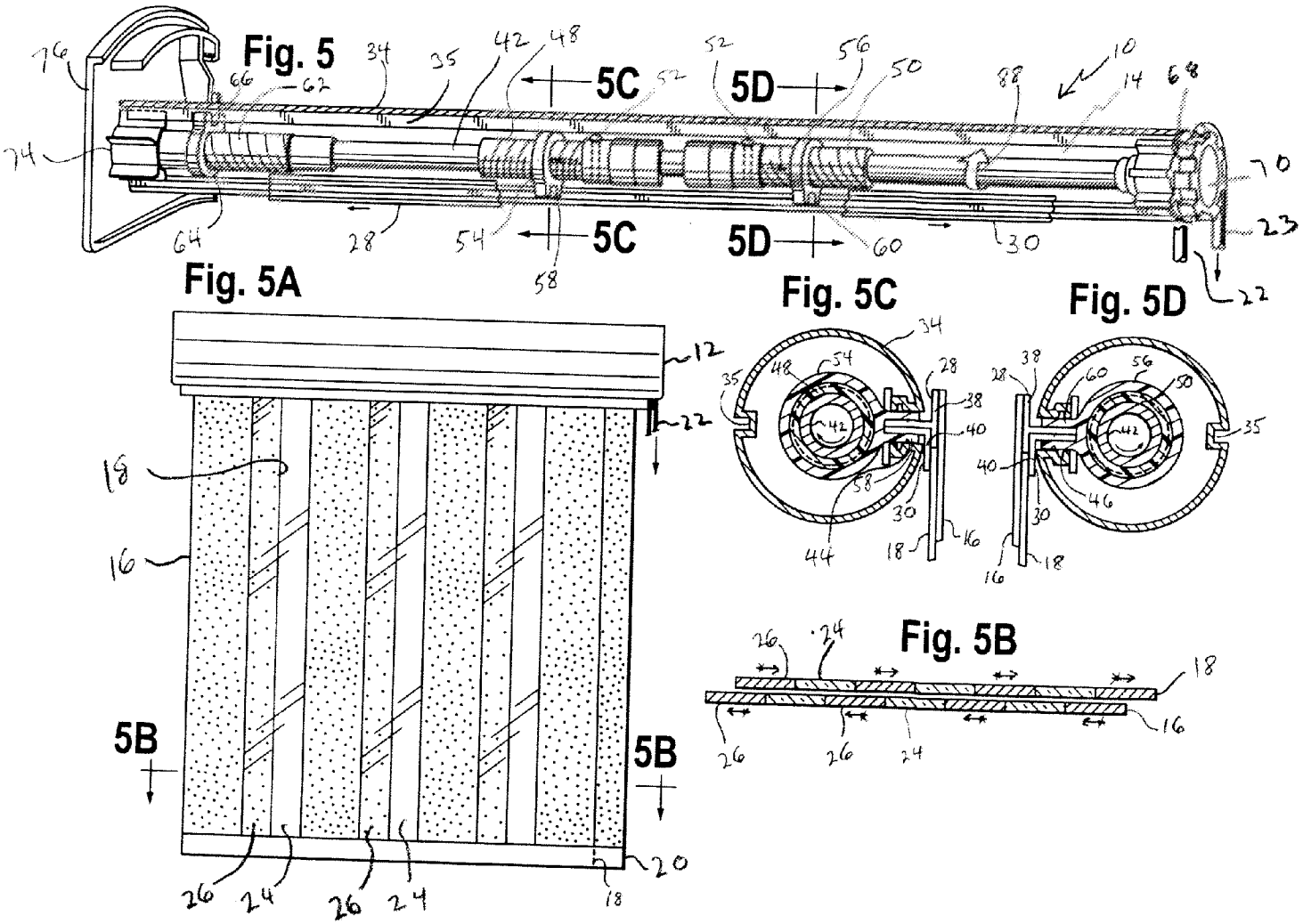
FIG. 5 is an assembly perspective cutaway drawing of the shade operating mechanism of FIG. 3, when the shade panels are being moved away from the full privacy position shown in FIG. 4A.
FIG. 5A is a front elevation view of the shade assembly of FIG. 1, showing the shade panels fully vertically deployed and the shade panels horizontally positioned where only a segment of each transparent portion of each shade panel is adjacent an opaque portion of the other shade panel.
FIG. 5B is a cross-section view of the shade panels of FIG. 5A, taken along line 5B-5B of FIG. 5A.
FIGS. 5C and 5D are each cross-sectional views of the horizontal shifting assemblies in the slotted tube, taken along lines 5C-5C and 5D-5D respectively of FIG. 5.

FIG. 4 illustrates the shade assembly 10 of FIG. 3, showing details of the operating or control mechanism 14. In FIG. 4 the horizontally movable shifter nuts 54, 56 re in their respective position when the shade panels 16, 18 are fully deployed, as illustrated in FIG. 4A, and the shade panels 16, 18 are horizontally positioned with each transparent material portion 24 located adjacent an opaque material portion 26 of the other penal, providing maximum privacy and allowing no or minimum light to passthrough the shade panels 16, 18 (FIG. 4B). In FIG. 4, the operating mechanism 14 is shown in its position when the forward and rear shade panels 16, 18 are fully deployed. Stop limit nut 64 is at its far leftward position in a direction towards the left end of control shaft 42, and the internal threads of stop nut 64 mate with the external threads of additional threaded portion 62. Shift nuts 54, 56 are each at their centermost position in relation to threaded surfaces 48 and 50, as seen in FIG. 4. The internal threads of shifter nut 54 mate with threaded surface 48, and the internal threads of shifter nut 56 mate with threaded surface 50. By continuing to pull on the cord 22 in the same direction after shade panels 16, 18 have been fully deployed and stop limit nut 64 has engaged the stop flange, control shaft 42 begins to rotate. Threaded surfaces 48, 50 are threaded in opposite directions, such that rotation of shaft 42 causes shifter nuts 54, 56 to move away from each other as seen in FIG. 5. Also, as seen in FIG. 4C, when slotted tube 34 is rotated, as will be explained, indented portion 35 of tube 34 engages saddle portion 66, thereby rotating stop limit nut 64 around additional threaded portion 62, moving stop limit nut 64 in an axial direction along control shaft 42.

FIG. 5 illustrates the shade operating mechanism 14 of FIG. 3 when the shade panels 16, 18 are fully vertically deployed, and the operator continues to pull on side 23 of cord 22 in the same direction after the shade panels 16, 18 have been fully deployed. Each shade panel 16, 18 is in the process of moving horizontally from the full privacy position shown in FIG. 4A. As seen in FIGS. 5A and 5B, the transparent panels 24 are now partially adjacent an opaque panel 26, allowing a partial degree of light to pass through the aligned portions of the transparent panels 24.

The process of shifting panels 16, 18 to their respective position shown in FIG. 5A is initiated by applying a manual pressure to one side 23 of cord 22, thus rotating shaft 42 as shown by arrow 88. As threaded surfaces 50, 52 rotate, shifter nuts 54, 56 move axially outward away from the center of control shaft 42, as seen in FIG. 5. Flange 58 (FIG. 3) of shifter nut 54 engages slot 44 on shifting mechanism 28 and moves shifter mechanism 28 to the left as seen in FIG. 5. Forward shade panel 16 is attached to shifter mechanism 28, (FIG. 3), and shade panel 16 also moves to the left (FIG. 5B). Simultaneously, flange 60 (FIG. 3) of shifter nut 56 engages slot 46 on shifting mechanism 30 and moves shifter mechanism 30 to the right as seen in FIG. 5. Rear shade panel 18 is attached to shifter mechanism 30 (FIG. 3) and shade panel 30 also moves to the right (FIG. 5B). FIGS. 5C and 5D provide details of the engagement of flanges 58 and 60 with grooves 44 and 46 on shifting mechanisms 28, 30 respectively.

Figure 6:
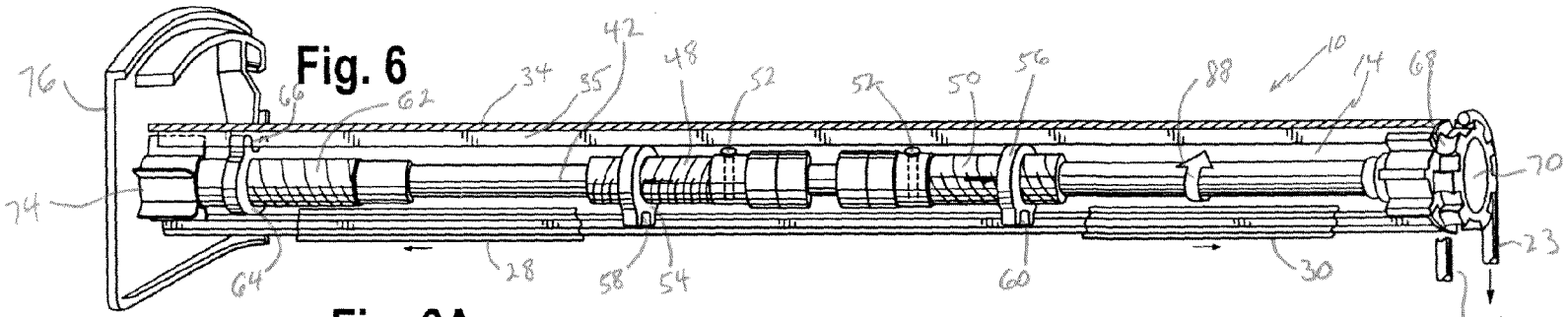
FIG. 6 is a cutaway perspective view of the shade operating mechanism of FIG. 3, when the shade panels are in their fully vertically deployed position and are in their maximum transparency position.
Figure 6A:
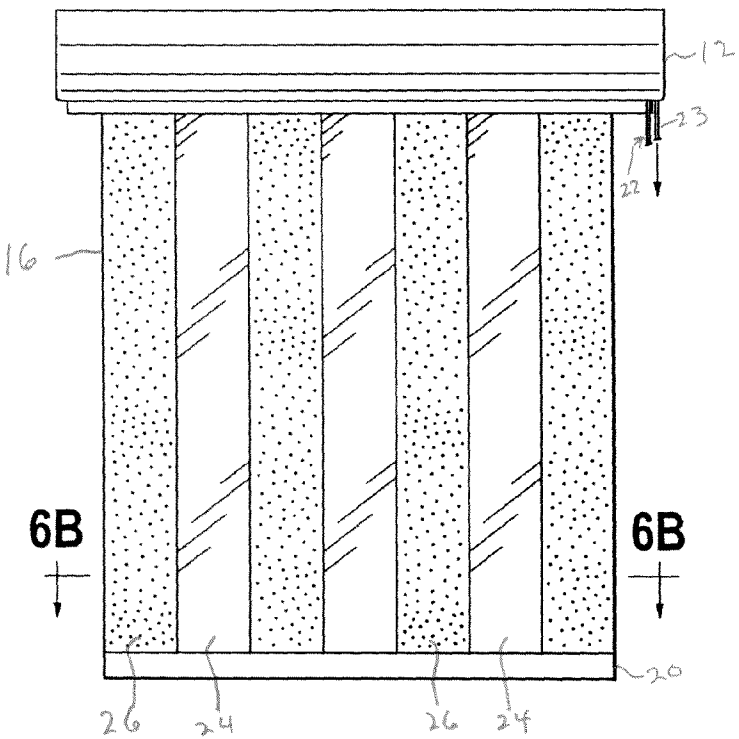
FIG. 6A is a front elevation view of the shade assembly of FIG. 1, showing the shade panels fully vertically deployed and the panels in their full transparency position.
Figure 6B:
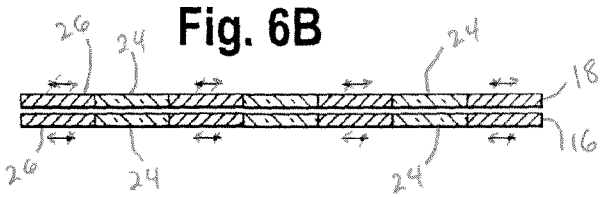
FIG. 6B is a cross-section view of the shade panels of FIG. 6A, taken along line 6B-6B of FIG. 6A.

FIG. 6 shows the relative position of the shifter nuts 54, 56 when the front and rear fully vertically deployed shade panels 16, 18 and have been horizontally moved to their maximum transparency positions, where each transparent material portion 24 of forward panels 16 is fully adjacent a transparent portion 24 of rear panel 18, as shown in FIGS. 6A and 6B. The outward movement of shifter nuts 54, 56 is halted when a stop portion 90, 92 of each shifting mechanism 28, 30, respectively, abuts a corresponding end cap 72, 76 or a similar flange on either end of canopy 12.

Figure 7:
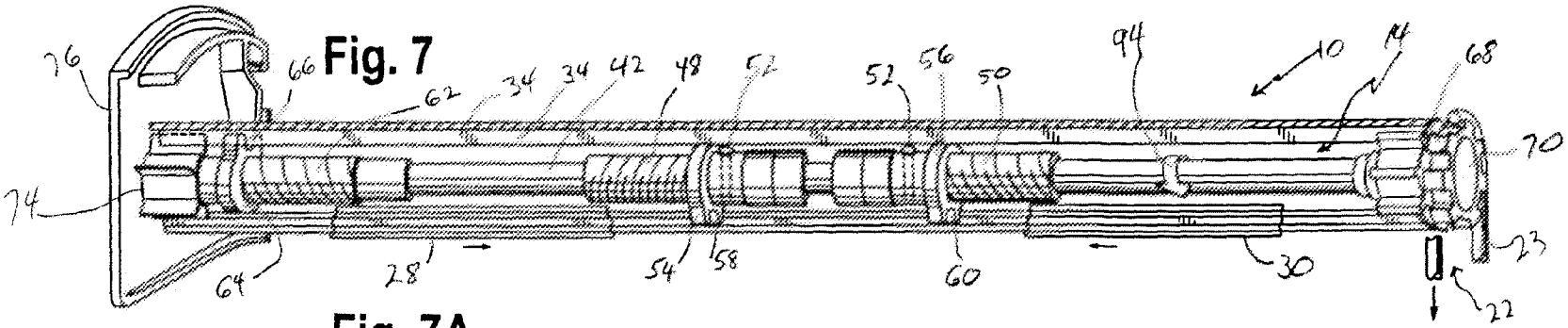
FIG. 7 is a perspective, cutaway assembly view of the operating assembly of FIG. 3, showing the position of the operating mechanism when the shade panels are fully deployed, and a force is applied to the operating card to begin vertically retracting the shade panels.
Figure 8:
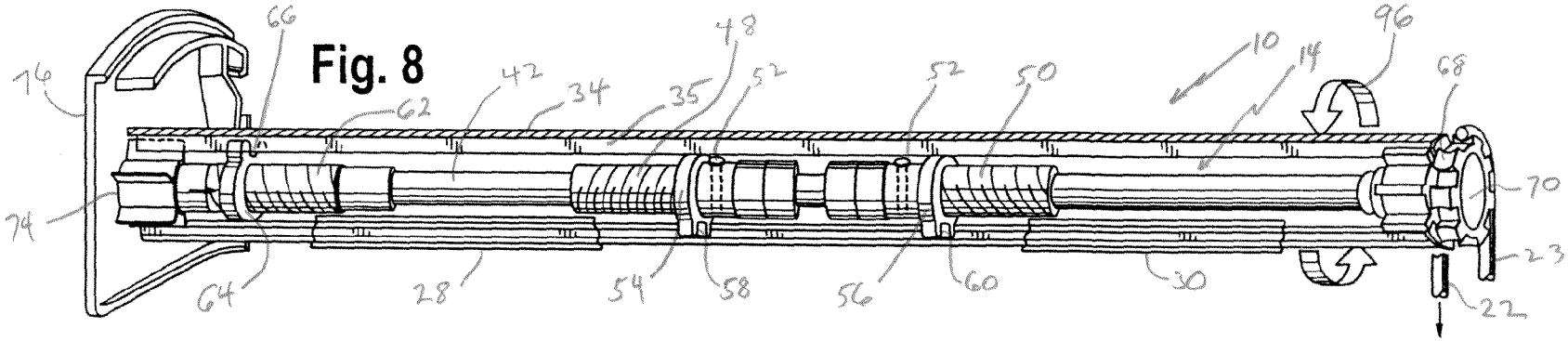
FIG. 8 is a cutaway, perspective assembly view of the shade operating mechanism of FIG. 3, when both shade panels have been partially vertically retracted.
Figure 8B:
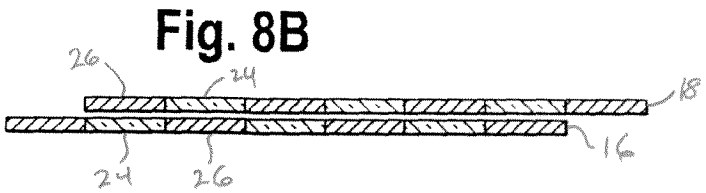
FIG. 8B is a cross-section view of the shade panels of FIG. 8A, taken along line 8B-8B of FIG. 8A.

The shade retraction operation of the control mechanism 14 is illustrated in FIGS. 7 and 8. With the shade panels 16, 18 in their fully deployed and maximum light position shown in FIGS. 6A and 6B, the operating card or chain 22 is pulled in the opposite direction by applying a downward force on the side of the cord or chain 22 opposite of side 23 (FIG. 7). Control shaft 42 rotates in the direction shown by arrow 94.

The threaded engagement between threaded portions 48, 50 of the control shaft 42 and the shift nuts 54, 56 drive the shift nuts toward each other, whereby the attachment flanges 28, 30 and the shade panels 16, 18 move back to the full privacy position, as shown in FIGS. 1 and 4A. Stops 78, 80, 86 (FIG. 3) located on the shift nuts 54, 56 and the control shaft 42 limit the lateral movement of the shifter nuts 54, 56 towards the center of the shade control shaft when the horizontal locations of the forward and rear panels 16, 18 have reached their desired full privacy positions, and the shifter nuts 54, 56 are unable to move any further towards each other.

Figure 7A:
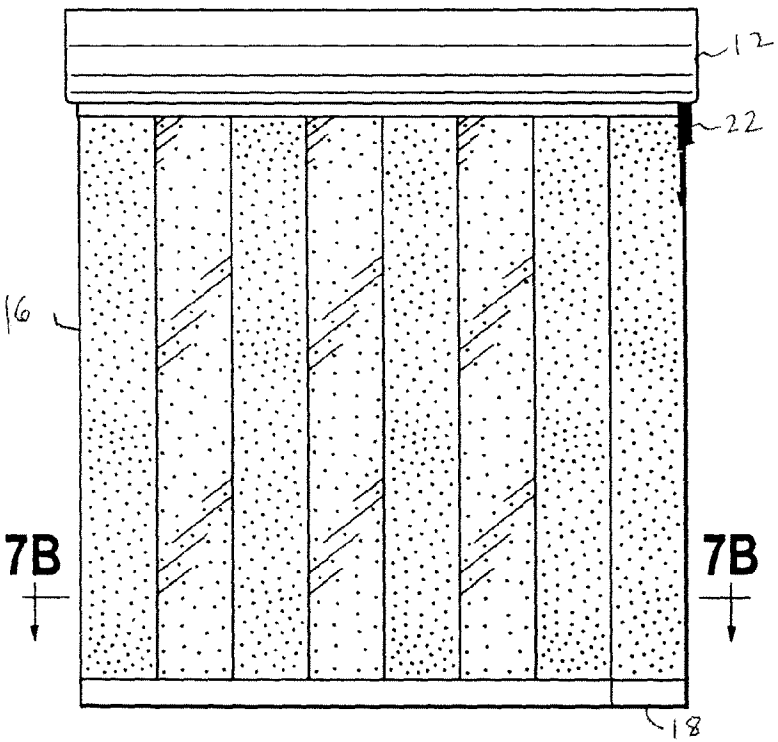
FIG. 7A is a front elevation view of shade assembly of FIG. 1, prior to vertically raising the panels.
Figure 7B:
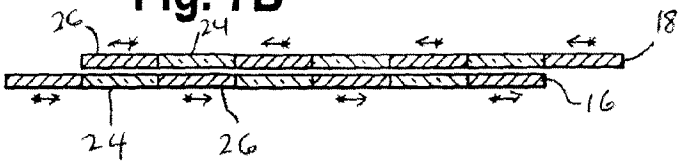
FIG. 7B is a cross-section view of the shade panels of FIG. 7A, taken along line 7B-7B in FIG. 7A.
Figure 8A:
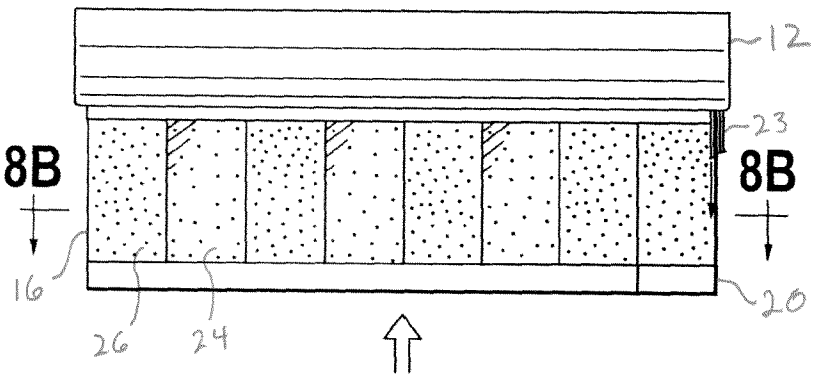
FIG. 8A is a front elevation view of the shade assembly of FIG. 1, showing the shade panels partially retracted into the slotted tube.

When the fabric panels have reached their full privacy position (FIG. 7A), continuing to apply a force to the operating cord or chain 22 in the same direction will cause the slotted tube 34 to rotate as shown by arrow 96 in FIG. 8, and the shade panels 16, 18 are both retracted around the slotted tube 34, as shown in FIG. 8A. The bottom rail 20 (FIGS. 12, 13) prevents the bottoms of the shade panels 16, 18 from entering the slot 36 in the slotted tube 34, thus preventing the fabric panels from continually flipping over tube 34 beneath the canopy 12.

As the shade panels 16, 18 are rolled onto the slotted tube 34, the stop limit nut 64 threadedly engaging the now stationary control shaft 42 is rotated by a positive engagement between the indented portion 35 of the slotted tube 34 and the saddle portion 66 of the stop limit nut 64, such that the stop limit nut 64 moves under the influence of additional threaded portion 62 in a direction laterally away from its existing position to a new position in a direction towards the center of the shade operating mechanism 14 as shown in FIG. 7. Each 360 degree turn of the stop limit nut 64 around its corresponding stationary additional thread portion 62 represents several inches of vertical movement of the shade panels 16, 18. The fabric panels 16, 18 can be retracted to any desired length. Once the shade panels 16, 18 are fully retracted, the stop limit nut 64 reaches its bottom out or idle position.

Figures 9, 9A:
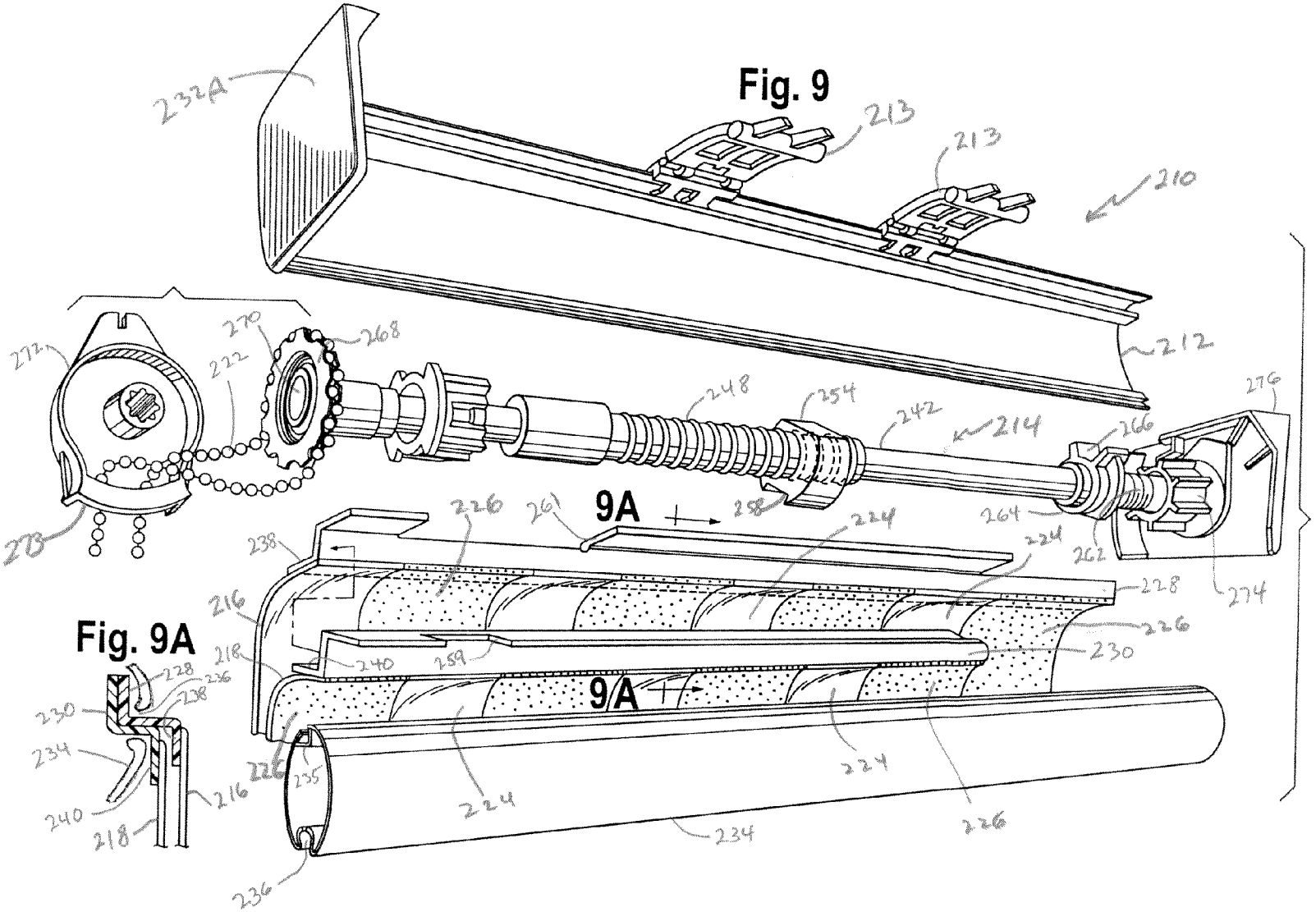
FIG. 9 is an exploded perspective schematic view of a further embodiment of a shade operating mechanism where one of the mounting surfaces supporting one of the shade panels is stationary.
FIG. 9A is a cross-section view of the embodiment of FIG. 9, taken along line 9A-9A of FIG. 9.
Figures 10, 10A, 10B, 10C:
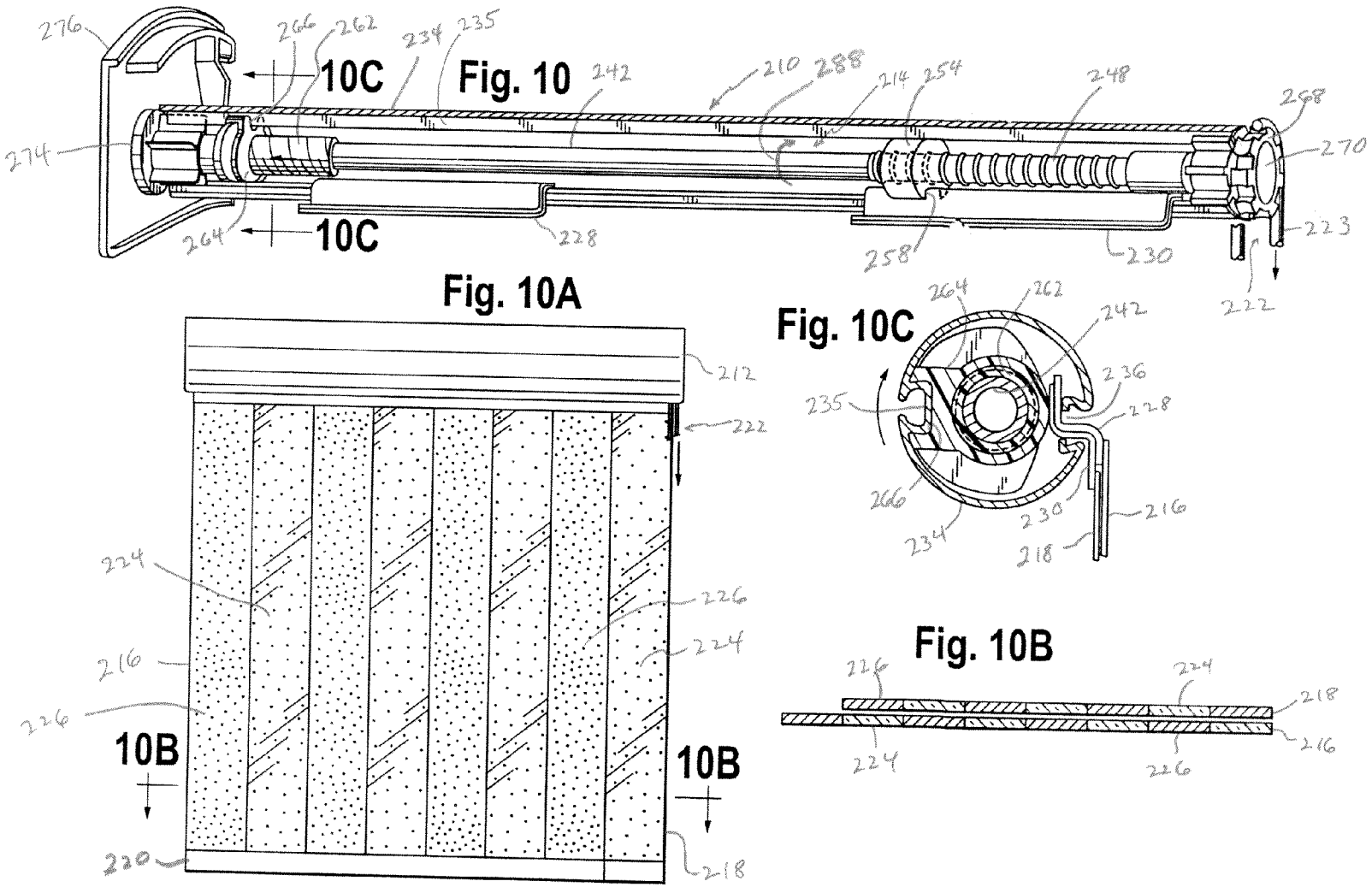
FIG. 10 is a cutaway assembly view of the shade panel operating mechanism of the embodiment of FIG. 9.
FIG. 10A is a front elevation view of the vertical hung shade assembly of FIG. 9.
FIG. 10B is a cross-section view of the shade panels shown in FIG. 10A, taken along line 10B-10B of FIG. 10A.
FIG. 10C is a cross-section view of the slotted tube and shade panel operating mechanism of FIG. 10, taken along line 10C-10C of FIG. 10.
Figures 11, 11A, 11B, 11C:
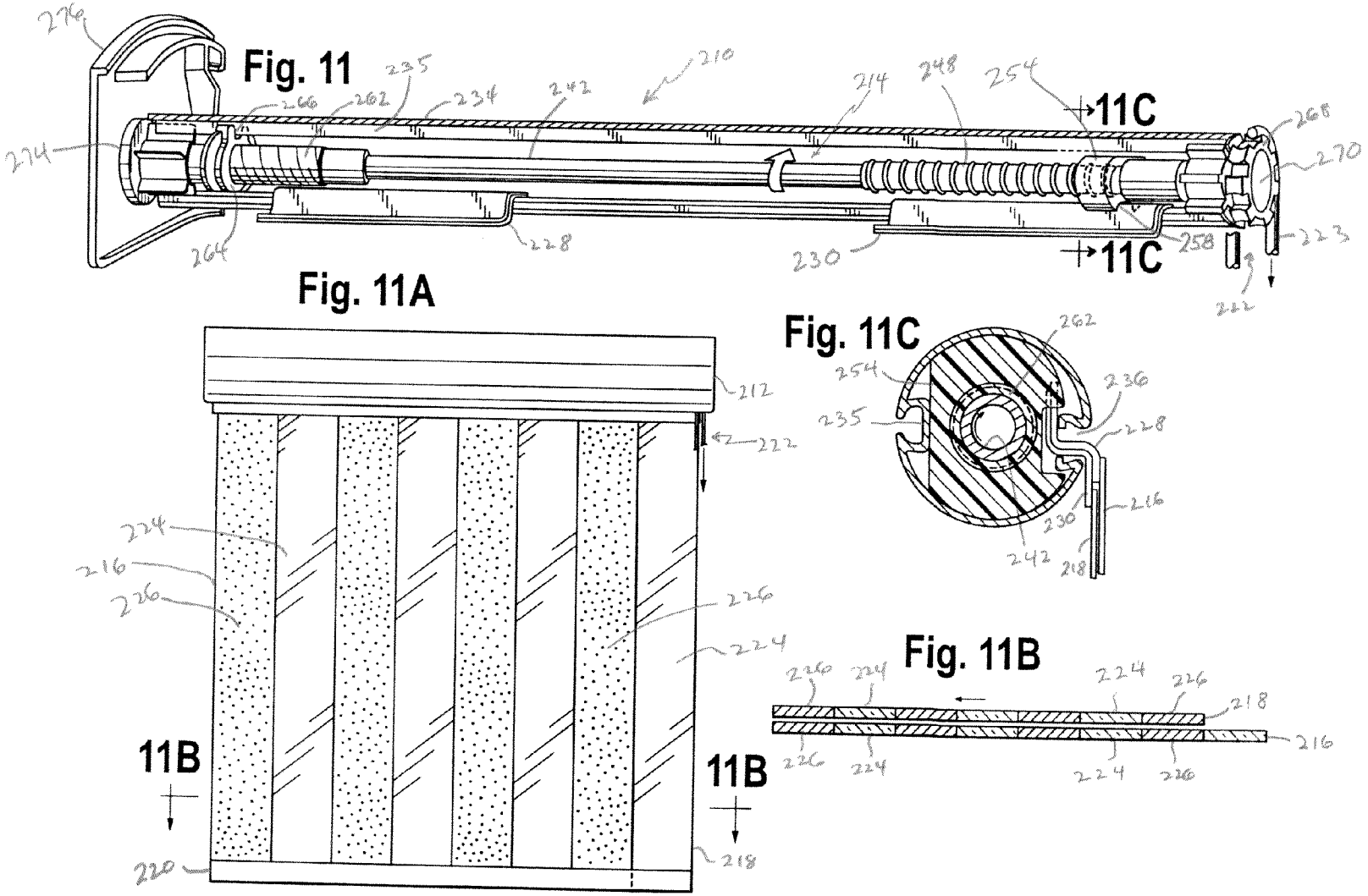
FIG. 11 is a further cutaway perspective assembly view of the shade operating mechanism of FIG. 9.
FIG. 11A is a front elevation view of the vertical hung shade panels of FIG. 9 in the fully deployed position.
FIG. 11B is a cross-section view of the shade panels shown in FIG. 11A, taken along line 11B-11B of FIG. 11A.
FIG. 11C is a cross-section view of the single horizontal shifting mechanism of the operating system of FIG. 11, taken along line 11C-11C of FIG. 11.

FIGS. 9-11 are assembly views of an embodiment of the shade operating mechanism 210 of the present invention where only the rear shade panel 216 shifts and the forward panel 216 remains stationary. Referring to FIG. 9, the shade panel operating mechanism 214 is housed in a canopy 212. A pair of shade guides 213 are pivotally mounted to canopy 212. A bracket 232A is adapted to attach canopy 212 to a wall or window frame. Forward shade panel 216 is attached to stationary support mechanism 228, and rear shade panel 218 is attached to horizontally movable support device 230. Each shade panel 216, 218 comprises alternate vertically extending transparent panels 224 and opaque panels 226.

Shaft 214 is located and rotatably supported inside slotted tube 234, as seen in FIGS. 10 and 11. Tube 234 includes an indented portion 235 and slot 236, each extending along the axial extent of tube 234. When assembled, panels 216, 218 extend downwardly out of slot 236. Stationary mechanism 228 includes an attachment flange 238 to which forward panel 216 is firmly attached. Movable shifting mechanism 230 comprises an attachment flange 240 to which rear panel 218 if firmly attached.

Operating mechanism 214 includes a control shaft 242 having a first threaded surface 248 and an additional threaded surface 262. A shifter nut 254 includes internal threads that engage threaded surface 248, such that as shaft 242 rotates, shifter nut 254 moves horizontally. In this embodiment, shifter nut 254 includes a saddle-type groove 258 that engages groove 259 in shifting mechanism 230. As shifting nut 254 moves horizontally upon the rotation of shaft 242, shifter mechanism 230 and shade panel 226 will move horizontally in either direction, depending on the direction of rotation of shaft 242. Stationary mechanism 228 includes a groove 261 through which shifter nut 254 extends and moves laterally when engagement with groove 266.

A stop limit nut 264 threadingly engages additional threaded portion 262 of shaft 242. Stop limit nut 264 has a saddle type-groove 266 that slideably engages indented portion 235 of tube 234, as seen in FIGS. 10 and 11. The stop limit nut 264 operates in the same manner as stop limit nut 64 in the embodiment of FIGS. 1-8. The end 270 of shaft 242 includes a shade panel deployment and retraction wheel 268 that engages and is rotated by a force applied to either side of chain 222. An end cap 272 encloses wheel 268, and the chain 222 extends downward through a slot 273 in end cap 272. The opposite end 274 of shaft 242 is supported by end cap 276.

FIG. 10 shows the positions of the operative elements of the single fabric panel horizontal shifting mechanism 214 shown in FIG. 9. The position of the stop limit nut mechanism 264 is in its position when the shade 216, 218 are fully deployed, as seen in FIG. 10A, and the shade panels are horizontally juxtaposed whereby each transparent portion 234 of one panel is located adjacent an opaque portion 226 of the other panel, as seen in FIGS. 10A and 10B. FIG. 10 also shows the position of the shift nut 254 threadingly engaging threaded portion 248 of the operating shaft 242. The shift nut 254 engages the movable shifting mechanism 230 via grooves 258 and 259, and the shift nut 254 is adapted to move horizontally along the operating shaft 242 upon rotation of the operating shaft 242 by an operator. The shade panel positioning shown in FIGS. 10A and 10B provides the maximum privacy and allows no or a minimum amount of light to pass through the shade assembly 210 from the window or opening treated by the window shade assembly of this embodiment of the present invention.

FIG. 10C is a cross-section view of the slotted tube 234 illustrated in FIG. 10, taken along line 10C-10C of FIG. 10. FIG. 10C illustrates the cross-sectional configuration of the slotted tube 234, the stop limit nut 264, and additional threaded portion 262 of shaft 242 that functions in limiting the deployment and retraction of the fabric panels 216, 218 around the circumference of slotted tube 234. FIG. 10C shows that the forward panels 216 is mounted to a stationary attachment flange 228, and the other fabric panel 218 is mounted to horizontally movable attachment flange 230. Stationary attachment flange 228 and moveable attachment flange 230 extend through slot 236 in slotted tube 234. Saddle portion 266 of stop limit nut 264 slidably engages indented portion 235 of tube 234, such that stop limit nut 264 moves laterally as shaft 242 is rotated, but stop limit nut 264 rotates with tube 234 as the shade panels 216, 218 are deployed from or retracted onto tube 234.

Referring to FIG. 10, when an operator applies a downward force on side 223 of cord or chain 222, shaft 242 rotates in the direction shown by arrow 288, moving shifter nut 254 in the rightward direction, as viewed in FIG. 10, until the shifter nut is in the position shown in FIG. 11. This movement of the shifter nut 254 moves the relative position of panels 216, 218 from their maximum privacy position as shown in FIGS. 10A and 10B, to a maximum light transmitting position as shown in FIGS. 11A and 11B.

As explained in the retraction operation of the embodiment of FIGS. 1-8, retraction of shade panels 216-218 around the circumference of tube 234 begins by applying a force on the side of cord or chain 222 opposite side 223, which moves the rear shade panel 218 from the position shown in FIG. 11B to the position shown in FIG. 10B, or to the full privacy position.

When the shade panels 216, 218 have reached their continued pulling on the opposite side of cord or chain 222 in the same direction causes tube 234 to rotate in a direction to retract the shade panels onto tube 234, since the movement of shifter nut 254 has reached its maximum centermost position, as seen in FIG. 10. The bottom rail 220 prevents the bottoms of shade panels 216, 218 from entering slot 236 in tube 234, thus preventing the fabric panels from continually flipping over tube 234 beneath canopy 212.

As shade panels 216, 218 are retracted and rolled onto tube 234, stop limit nut 264 threadingly engaging the now stationary control shaft 242 is rotated by the positive engagement between indented portion 235 of tube 234 and the saddle portion or groove 266 of stop limit nut 264. The stop limit nut, under the influence of additional threaded portion 262, moves in a direction away from its existing position toward the end 274 of shaft 242, to a new position in a direction towards the center of shaft 242. As in the embodiment of FIGS. 1-8, each 360 degree turn of the stop limit nut 264 around additional thread portion 262 represents several inches of vertical movement of the shade panels 216, 218. The panels 216, 218 can be retracted to any desired length. Once a vertical force applied to cord or chain 222 is released during the retraction process, the friction force between stop limit nut 264 and threads 262 prevents the stop limit nut from further rotative movement, thus holding tube 234 in its selected position. Upon full retraction of the panels 216, 218 onto the tube 234, the stop limit nut reaches its bottom out position.

Figure 12:
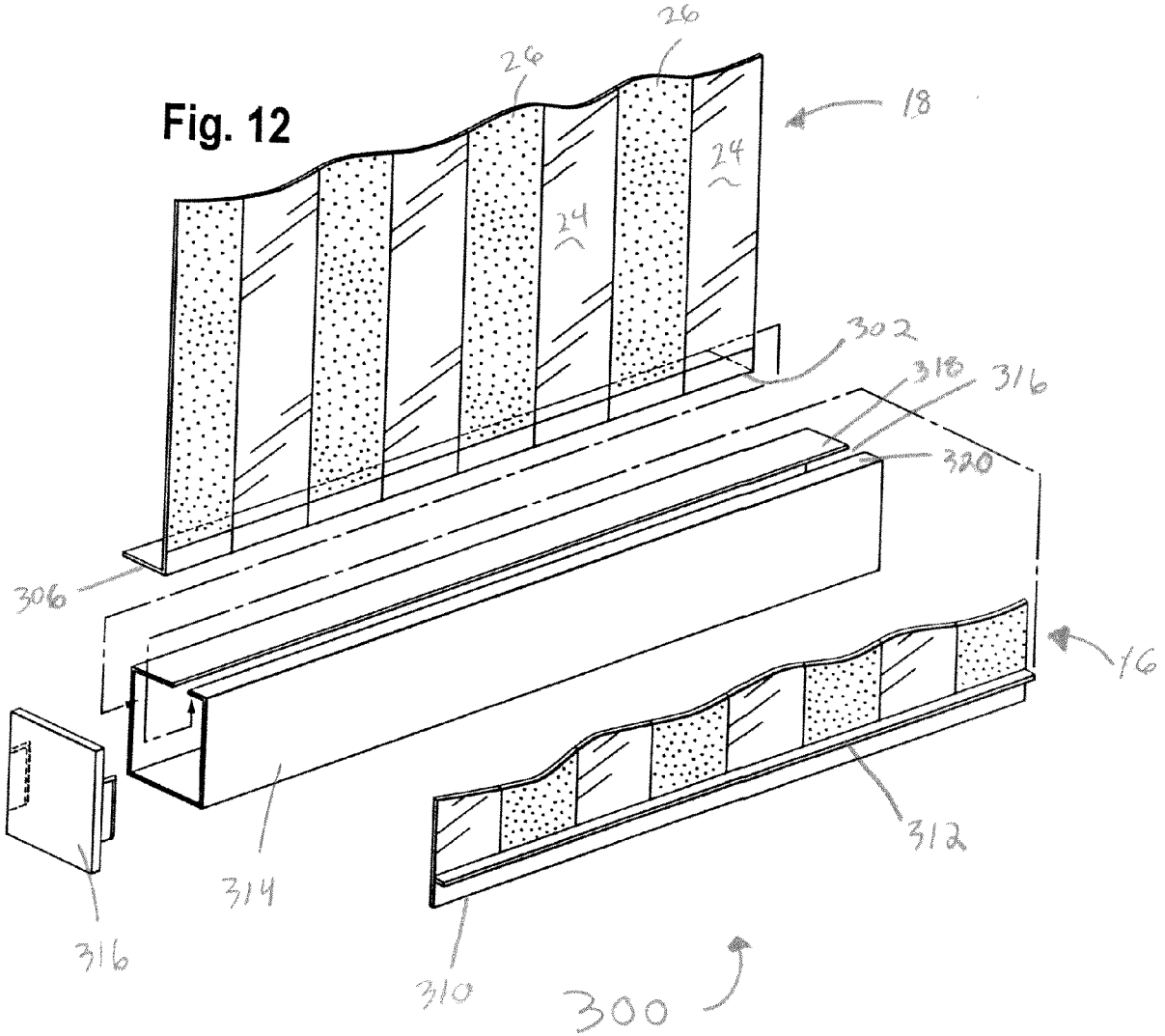
FIG. 12 is an exploded schematic perspective view of an embodiment of a bottom rail assembly used with the embodiment of the present invention illustrated in FIGS. 1-8.

FIG. 12 is an exploded schematic perspective view of an embodiment of a bottom rail assembly 300 usable with the embodiments of the present invention shown in FIGS. 1-11. FIG. 12 shows a bottom edge 302 of the rear fabric panel 18 having a rearwardly extending L-shaped flange 306 extending along the horizontal length of the rear panel 18. The forward fabric panel 16 has a bottom 310 with a forwardly-extending L-shaped flange 312 extending along the horizontal length of the forward panel 16 a short distance above the bottom 310. A tubular channel member 314 and end cap 316 receive the flanges 306 and 312. The tubular channel member 314 has a slot 316 in the upper surface formed by a rear flange 318 and a forward flange 320 on the upper surface. The rear panel 18 extends through slot 316, lodging flange 306 inside the hollow portion of tubular channel member 314, whereby the upper surface of the L-shaped flange 306 either engages or is at a short distance from the lower surface of the rear flange 318 of the channel member 314, depending upon the different deployment and retraction distances traveled by the rear fabric panel 18. The forward fabric panel 16 also extends through the slot 316 such that flange 312 is located in the tubular channel member 314, whereby the upper surface of the L-shaped flange 312 constantly engages the lower surface of the forward flange 320 of the channel member 314 as the fabric panels are deployed or retracted. The weight of bottom rail 300 is sufficient to apply a downward force on the shade panels allowing ease of deployment and removal of wrinkles in the panels. End caps 316 prevent the flanges 306, 312 from sliding out of slot 316.

Figure 13:
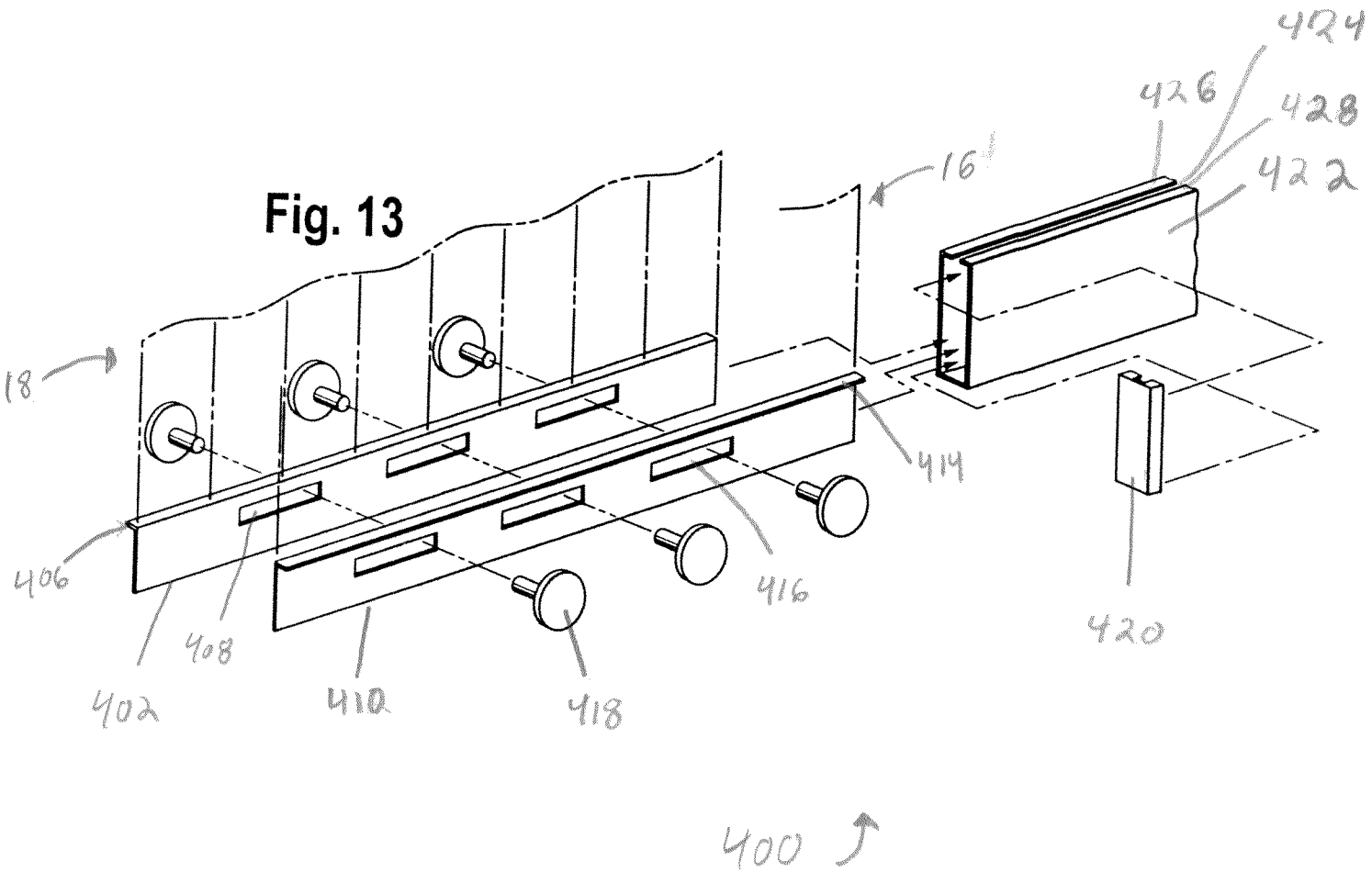
FIG. 13 is an exploded schematic perspective view of an alternate embodiment of the bottom rail assembly shown in FIG. 12.

FIG. 13 is an exploded schematic perspective view of an alternate embodiment of a bottom rail assembly 400 usable with the embodiments of the present invention shown in FIGS. 1-11. FIG. 13 shows a bottom edge 402 of the rear panel 18 having an L-shaped flange 406 fastened to the bottom edge 402 of the rear panel 18. The L-shaped flange 406 extends rearwardly along the horizontal length of the rear panel 18. The L-shaped flange 406 also includes a plurality of laterally elongated slots 408. FIG. 13 further shows a bottom edge 410 of the forward panel 16 having an L-shaped flange 414 fastened to the bottom edge 410 of the forward panel 16. The L-shaped flange 414 forwardly extends along the horizontal length of the forward panel 16. The L-shaped flange 414 further has a plurality of laterally elongated slots 416. Rivet-type pins 418 extend through the plurality of elongated slots 408 and 416 such that the bottoms of the panels 16 and 18 are held close together, and the panels 16 and 18 are able to move vertically with respect to one another due to the sloppy fit between the pins 418 in the slots 408 and 416. The panels 16 and 18 are also allowed freedom of horizontal movement in relation to one another as a result of the shape of the slots 408 and 416, such movement limited by the slot length and an end cap 420. The end cap 420 is attached to a bottom rail member 422 having a slot 424 allowing the fabric panels 404 and 412 to extend into the rail member 422. The L-shaped flanges 406 and 414 are adapted to engage under the surface of a respective rear flange 426 and forward flange 428 of the bottom rail member 422.

Figure 14:
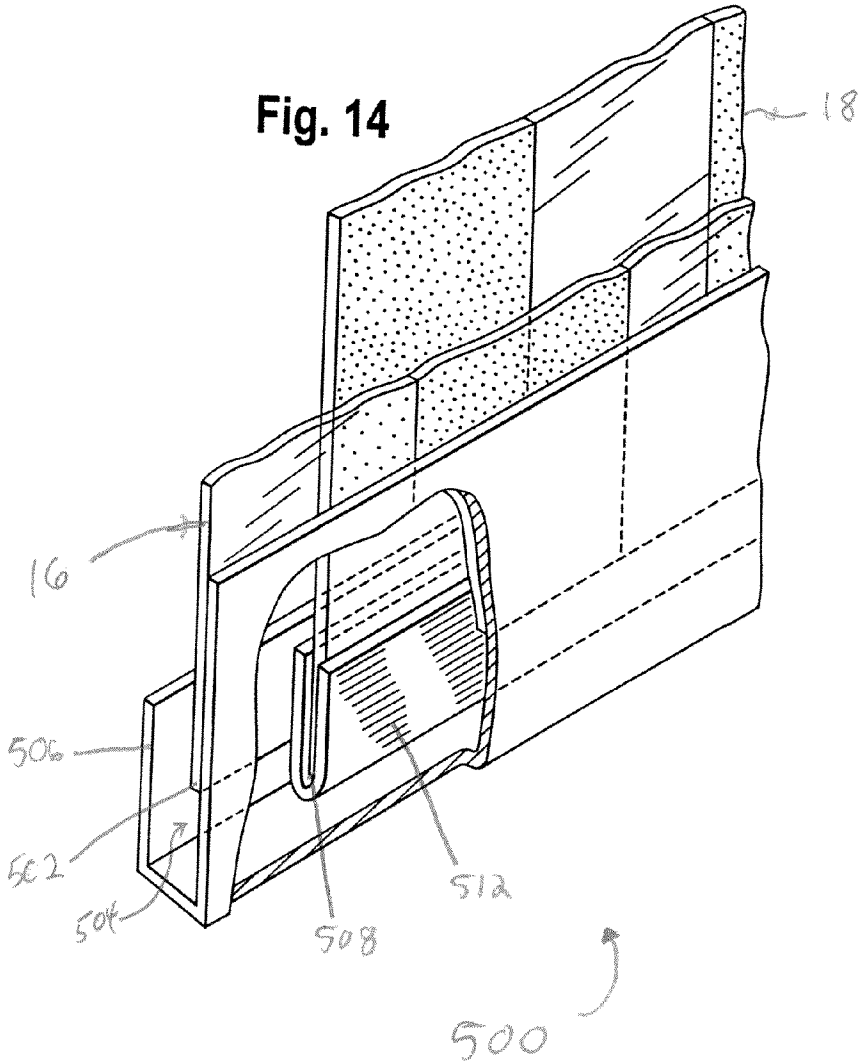
FIG. 14 is a perspective detail partial cutaway view of a bottom rail assembly used in conjunction with the embodiment of the present invention illustrated in FIGS. 9-11.

FIG. 14 is a perspective detail partial cut away view of another bottom rail assembly 500 usable with the embodiments of the present invention shown in FIGS. 9-11. FIG. 14 shows a bottom edge 502 of the forward panel 16 attached to a U-shaped flange 506 that forms an open channel 504 below the forward panel 16. The bottom edge 508 of the rear panel 18 has a weight bar 512 attached, forming a bottom rail of the rear panel 18. The bottom rail 512 of the rear panel is spaced from the bottom of the U-shaped flange 506 attached to the forward panel 18 so that the rear panel 510 can move freely in a lateral direction relative to the channel formed by the U-shaped flange 506.

In each of the embodiments of FIGS. 12, 13 and 14, the bottom rail structures provide a degree of relative vertical movement between the front and rear shade panels 16, 18. When the shade panels 16, 18 are deployed from, or retracted onto, slotted tube 34, the vertical distance each panel travels may vary in relation to the other panel as a factor of the thickness of the panels. By not attaching the bottom of both panels to the bottom rail, or by creating a sloppy fit between the flanges attached to the panels and the bottom rail, the panels can be deployed and retracted without the panels buckling.

While the specification of the invention is described in relation to certain implementations or embodiments, many details are set forth for purposes of illustration. Thus, the foregoing merely illustrates the principles of the invention. For example, this invention may have other specific forms without departing from its spirit or essential characteristics. The described arrangements are illustrated and not restricted. To those skilled in the art, the invention is susceptible to additional implementations or embodiments and certain of the details described in this specification can be varied considerably without departing from the basic principles of the invention. It will thus be appreciated that those skilled in the art will be able to devise various arrangements that, although not explicitly described or shown here, embody the principles of the invention. They are thus within the spirit and scope of the invention.

What is claimed:

1. A plural panel vertically hung adjustable light transmitting window shade apparatus for varying the amount of light passing through the plural panels, comprising:

a rotatable slotted tube having an outer surface;

a control shaft in the slotted tube, the shaft mounted for rotation within said tube;

at least one shifting nut threadingly engaging said control shaft, rotation of said control shaft imparting lateral movement to said at least one shifting nut;

at least one mounting surface engaging the at least one shifting nut, lateral movement of said at least one shifting nut imparting lateral movement to each said at least one mounting surface;

a shade panel attached to each of said at least one mounting surface, each shade panel extending downward from said tube, said shade panels moveable in lateral directions upon rotation of said control.

2. The plural panel window shade apparatus of claim 1, wherein:

said slotted tube is rotatably mounted in a canopy, said canopy having a chamber in which said control shaft is mounted.

3. The plural panel window shade apparatus of claim 1, wherein:

said plural panels extend from said at least one mounting surface disposed in said slotted tube and through said slot in said slotted tube.

4. The plural panel window shade apparatus of claim 1, wherein:

said at least one shifting nut comprises a first and a second shifting rail;

said at least one mounting surface comprises a first and a second mounting surface, said first shifting nut engaging said first mounting surface and said second shifting nut engaging said second mounting surface; and a first panel attached to and extending downward from said first mounting surface, and a second panel attached to and extending downward from said second mounting surface.

5. The plural panel window shade apparatus of claim 1, comprising:

a stop limit nut threadingly engaging said control shaft and slidably engaging said slotted tube;

rotation of said slotted tube imparting rotational and lateral movement of said stop limit nut;

said stop limit nut having a maximum lateral position that prevents further rotation of the slotted tube.

6. The plural panel window shade apparatus of claim 1, comprising:

at least two first stop elements on said control shaft;

second stop elements on each of said shifting nut;

lateral movement of said shifting nuts ceasing upon contact between a corresponding first stop element and a second stop element.

7. The plural panel window shade apparatus of claim 1, wherein:

a bottom rail substantially encloses a bottom end of each of said plural panels, the bottom rail allowing at least one of said panels to move laterally relative to said bottom rail.

8. The plural panel window shade apparatus of claim 7, wherein:

each of said plural panels has a flange attached to the bottom of each panel, said flanges adapted for independent lateral movement relative to said bottom rail.

9. The plural panel window shade apparatus of claim 7, wherein:

said plural panels comprise two panels; and each panel is vertically moveable relative to the other panel.

10. The dual panel window shade apparatus of claim 7 wherein:

said bottom ends of said first and second panels are horizontally slotted, and said bottom ends are slidably connected by at least one loose fitting pin member.

11. The dual panel window shade apparatus of claim 7 wherein:

the bottom end of one of said panels is attached to the bottom rail, and the other of said panels is movable relative to said one panel and to said bottom rail.

* * * * *